US008883075B2

(12) United States Patent
Henry et al.

(10) Patent No.: US 8,883,075 B2
(45) Date of Patent: Nov. 11, 2014

(54) RAZOR DISINFECTION AND STORAGE DEVICE

(71) Applicants: Christopher J Henry, Palm Beach Gardens, FL (US); Robert F Patterson, Royal Palm Beach, FL (US)

(72) Inventors: Christopher J Henry, Palm Beach Gardens, FL (US); Robert F Patterson, Royal Palm Beach, FL (US)

( * ) Notice: Subject to any disclaimer, the term of this patent is extended or adjusted under 35 U.S.C. 154(b) by 166 days.

(21) Appl. No.: 13/760,058

(22) Filed: Feb. 6, 2013

(65) Prior Publication Data

US 2014/0215971 A1 Aug. 7, 2014

(51) Int. Cl.

| | |
|---|---|
| ***A61L 2/00*** | (2006.01) |
| ***B26B 19/00*** | (2006.01) |
| ***A45D 27/22*** | (2006.01) |
| ***B65D 81/24*** | (2006.01) |
| ***A45C 11/26*** | (2006.01) |
| ***A47L 13/12*** | (2006.01) |
| ***B65D 5/56*** | (2006.01) |
| ***A45D 27/46*** | (2006.01) |

(52) U.S. Cl.

CPC ..... *A45D 27/46* (2013.01)
USPC ..... 422/28; 422/560; 422/300; 30/41; 30/538; 30/541; 206/208; 206/352; 222/129; 222/132

(58) Field of Classification Search

CPC ..... A61L 2/00; A61L 2/0088; A61L 2/18
USPC ..... 422/1, 28, 560, 300; 30/41, 538, 541; 206/208, 352; 15/104.92, 106; 222/129, 132

See application file for complete search history.

(56) References Cited

U.S. PATENT DOCUMENTS

2011/0138638 A1* 6/2011 Winsell ..... 30/538

* cited by examiner

*Primary Examiner* — Monzer R Chorbaji
(74) *Attorney, Agent, or Firm* — Vinod Doddamani

(57) ABSTRACT

An attractive and compact device and an effective method to store and disinfect a manual shaving razor are disclosed. The method reduces corrosion of the razor's metal blades. A compact container has separate but suitably connected chambers allowing for economy of use of as disinfectant liquid combining alcohol, detergent or soap and skin conditioner. By protecting the razor in one enclosed chamber, oxidative damage and rusting of blades is avoided. A knife edge element is placed at the bottom of another chamber to pierce the foil seal of a suitably inserted bottle within the other chamber. An optional third, drainage chamber below the other two chambers allows for appropriate drainage and removal both of excess fluid used, as well as hair and debris from the blades. The design of the device is compact and attractive, as is the method an extremely effective way of protecting and disinfecting the razor.

20 Claims, 5 Drawing Sheets

RAZOR DISINFECTION AND STORAGE DEVICE

FIELD OF THE INVENTION

The present invention relates to the shaving arts and specifically to storage and disinfection of shaving razors for hygiene and safety.

BACKGROUND OF THE INVENTION

Many people use shaving razors with exposed blades to remove unwanted facial and body hair. These shaving razors with exposed blades are commonly referred to as manual razors as opposed to electric razors. Manual razors often are disposable or have replaceable heads which encapsulate the blade or blades. Electric razors have motor driven blades covered by a thin shield to protect the skin. The distinction between manual and electric shavers have blurred over time as manufacturers have incorporated vibrating motors with shaving razors having exposed blades, and are not as disposable as they once were. We will use the term manual razor to refer to all shaving razors having exposed blades regardless of whether or not they incorporate a motor or vibrating component. We will use the term electric razor for all razors that incorporate the motor or vibrating component and blades covered by a thin shield to protect the skin.

Manual razors have evolved into sophisticated devices often containing as many as five or more blades. In all cases the blades of manual razors eventually wear out and need to be replaced, either be replacing the entire shaver or by replacing the head of the razor. Over time, manufacturers have extended the average useful life of the blades of manual razors by producing a better quality blade. Many manufacturers claim the useful life of their blade is four weeks or more. The manual razors with multiple blades that have a long life blade system are expensive, whether or not the razor is designed to be a disposable razor.

Once the manual razor has been used, the blades are rinsed with water and left on the counter or in a drawer with the blade or blades still wet. A wet blade accelerates oxidation or rusting of the blade or blades. Oxidation of the blades reduces the life-span of these expensive blades. The moist blade also increases bacteria growth. Bacteria and a rusted blade increase the occurrence of poor performance and the risk of contaminated cuts and scrapes.

SUMMARY OF THE INVENTION

It is the primary objective of the present invention to provide an attractive and space-efficient device for storing and disinfecting a manual shaving razor that reduces the corrosion of the blades. Another objective of the present invention is to provide a manual device for storage and disinfection of a shaving razor permitting easy replenishment of the disinfectant solution. Yet another objective of the present invention is to provide a method to manually store and disinfect a shaving razor which is easy and thorough. A further objective of the present invention is to provide a manual shaving razor storing and disinfecting device which is aesthetically pleasing and occupies not much more space than a shaving razor lying flat on the countertop.

The present invention fulfills the above and other objects by providing a rigid container with a flip-up lid allowing a manual shaving razor to be inserted in to the device. Closing the lid prevents any debris from entering the device and slows evaporation of the disinfectant solution. An attractive and compact device is disclosed along with an accompanying method to store and disinfect a manual shaving razor. The device and method reduce the likelihood of corrosion of the metal blades and increase the razor's life. The compact constituent container has separate chambers which are connected appropriately to allow economy of use of a disinfectant liquid which may combine alcohol, detergent or soap and skin conditioner. Protecting the razor in an enclosed chamber prevents oxidative damage and rusting of blades. The invention utilizes a knife edge element at the bottom of the other bottle receiving chamber that is able to pierce the foil seal of a container or bottle inserted suitably within one of the chambers of the device. The design of the device is intended to be compact and attractive, which add to its novelty and utility.

The method of use of the device is an extremely effective way of protecting and disinfecting the razor. When a manual shaving razor is inserted in the device, a rest element supports the handle of the shaving razor at the correct angle so that the razor blade elements are submerged in the disinfectant solution. The disinfectant solution is maintained automatically at the correct depth by the configuration of various elements of the device. The razor blade elements are supported at a predetermined height above the bottom of the device by a series of ridges which rise from the bottom of one of the chambers. The bottle containing the disinfectant solution is replaceable. The bottle is inserted into and fits snugly into the bottle receiving chamber within the device. It may be sealed with both a screw cap and an inner foil seal. On introducing a bottle with a new supply of disinfectant solution, the user removes the screw cap and inverts the bottle while the liquid is retained by the inner foil seal. The user then inserts the bottle into the bottle receiving portion of the device and the inner foil seal is punctured by a knife edge element located in the bottle receiving portion of the device, thereby allowing the cleaning and disinfecting fluid to flow into the device. Support elements in the bottle receiving portion of the device hold the bottle at a precisely pre-determined height which allows the correct amount of liquid to flow into the device. A third optional drainage chamber below the other two chambers allows appropriate drainage and removal both of excess fluid used, as well as hair and debris from the blades. The overall design of the device is very compact and attractive.

BRIEF DESCRIPTION OF THE DRAWINGS

The present invention, both as to its organization and manner operation, together with further objects and advantages, may best be understood by reference to the following description, taken in connection with accompanying drawings, in which.

DETAILED DESCRIPTION OF THE PREFERRED EMBODIMENTS

The objects and features of the present invention, which are considered novel and useful, are set forth with particularity in the following description. The following embodiments are provided to enable any person skilled in the art to make and use the invention and set forth the best modes contemplated by the inventor of carrying out his invention. Various modifications, however, will remain readily apparent to those skilled in the art, since the generic principles of the present invention have been defined herein specifically to provide for a novel and improved manual razor cleaning and storage device. Nothing in this description is to be considered limiting and all possible modifications are to be construed as incorporated into the invention.

Figure 1:
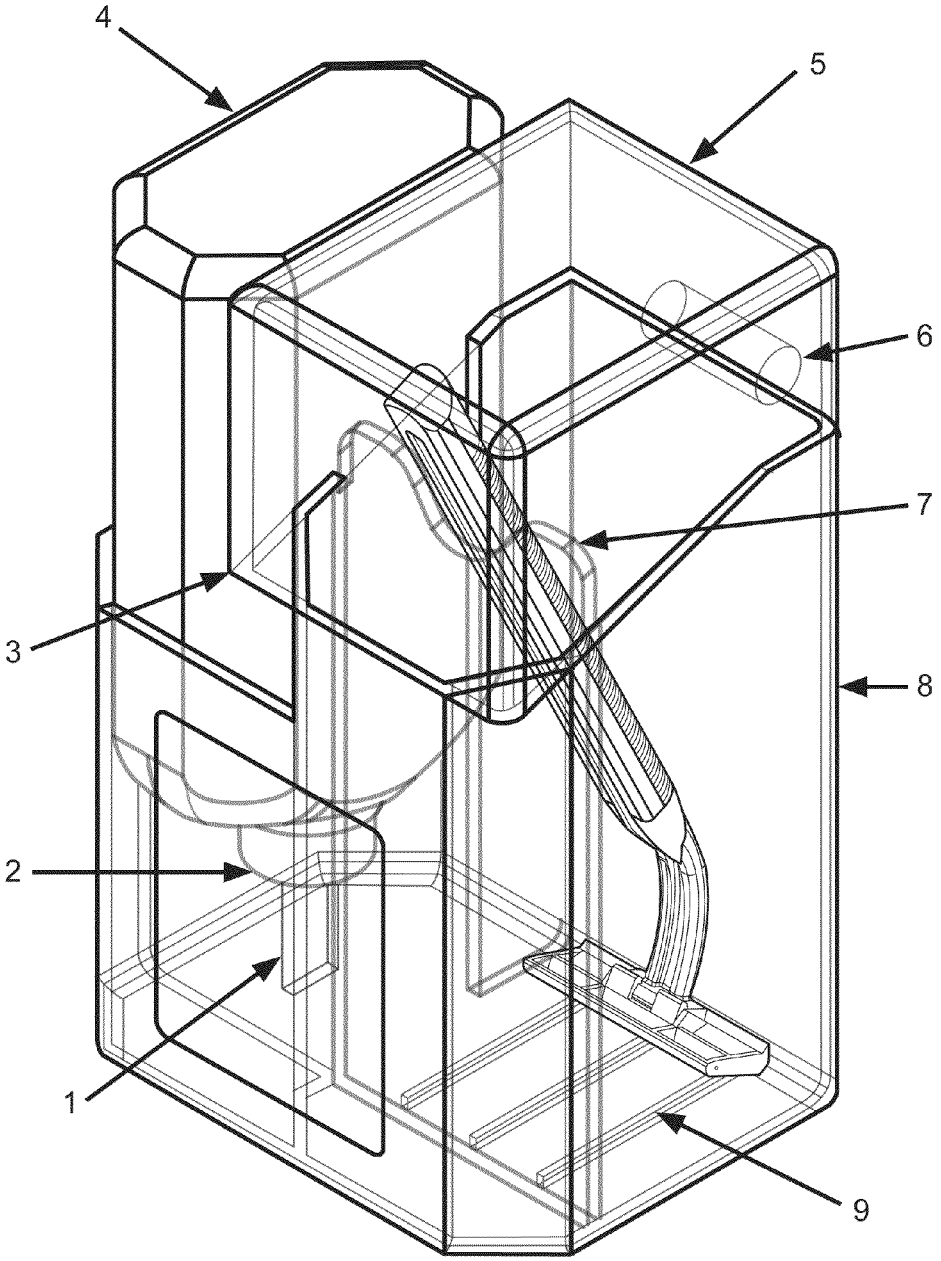
FIG. 1 is an angled front and left side view of the present invention.
Figure 4:
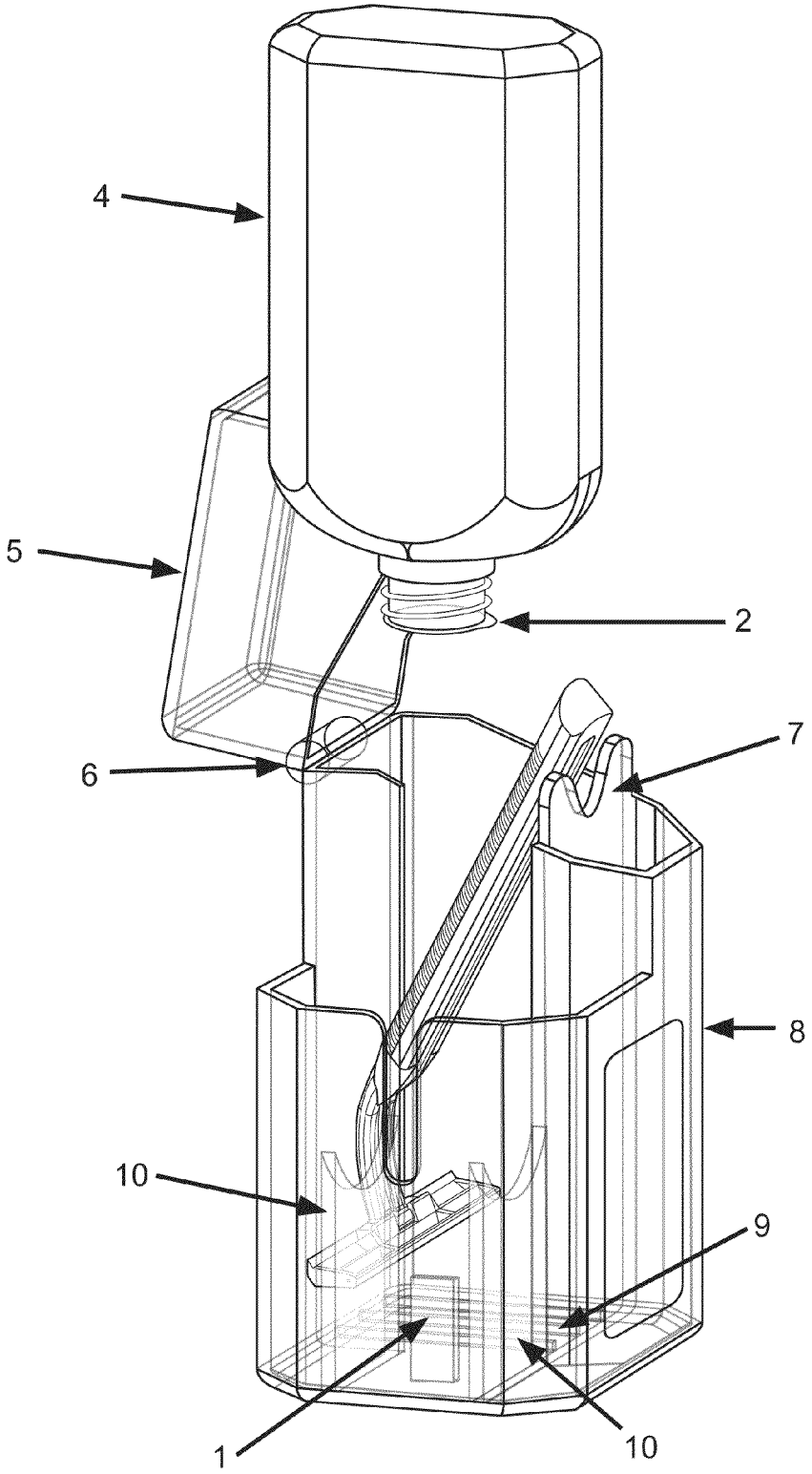
FIG. 4 is an angled front and right side view of the present invention, the flip top open, the rest element exposed, and the inverted bottle of disinfectant solution.

FIG. 1 is an angled front and left side view of the present invention in its sealed and most basic configuration. The invention, i.e. the razor storage and disinfectant device, is mostly left closed and if small enough and watertight, may be carried for travel. The present invention may be constructed as a rectangular rigid storage device in molded rigid plastic, designed to hold a manual shaving razor and a disinfectant solution. As shown in FIG. 4, disinfectant solution is introduced to the storage device by means of an inverted replaceable plastic bottle [4] of disinfectant solution. The flip top [5] is shown open and the rest element [7] is exposed. New bottles of disinfectant solution are sealed with a screw cap and an inner foil seal [2]. To introduce the disinfectant solution to the cleansing chamber [A], the screw cap is removed and the bottle [4] is inverted with the disinfectant solution retained by the inner foil seal [2]. The inverted bottle is then inserted into the container chamber [B] of the storage device, held in place by two concave rests [10] that cradle the bottle and allow for sufficient flow of the disinfectant solution. Within the container chamber [B] of the device, a knife edge element [1] which pierces the inner seal [2] on the bottle allowing the disinfectant solution to how into the cleansing chamber [A], through an aperture in the dividing partition of the two chambers. The disinfectant solution will flow freely into the cleansing chamber [A] to the level of the lip of the inverted plastic bottle. Fresh disinfectant solution will seep into the cleansing chamber [A] as the level of the disinfectant solution dips below the lip of the inverted plastic bottle.

Figure 2:
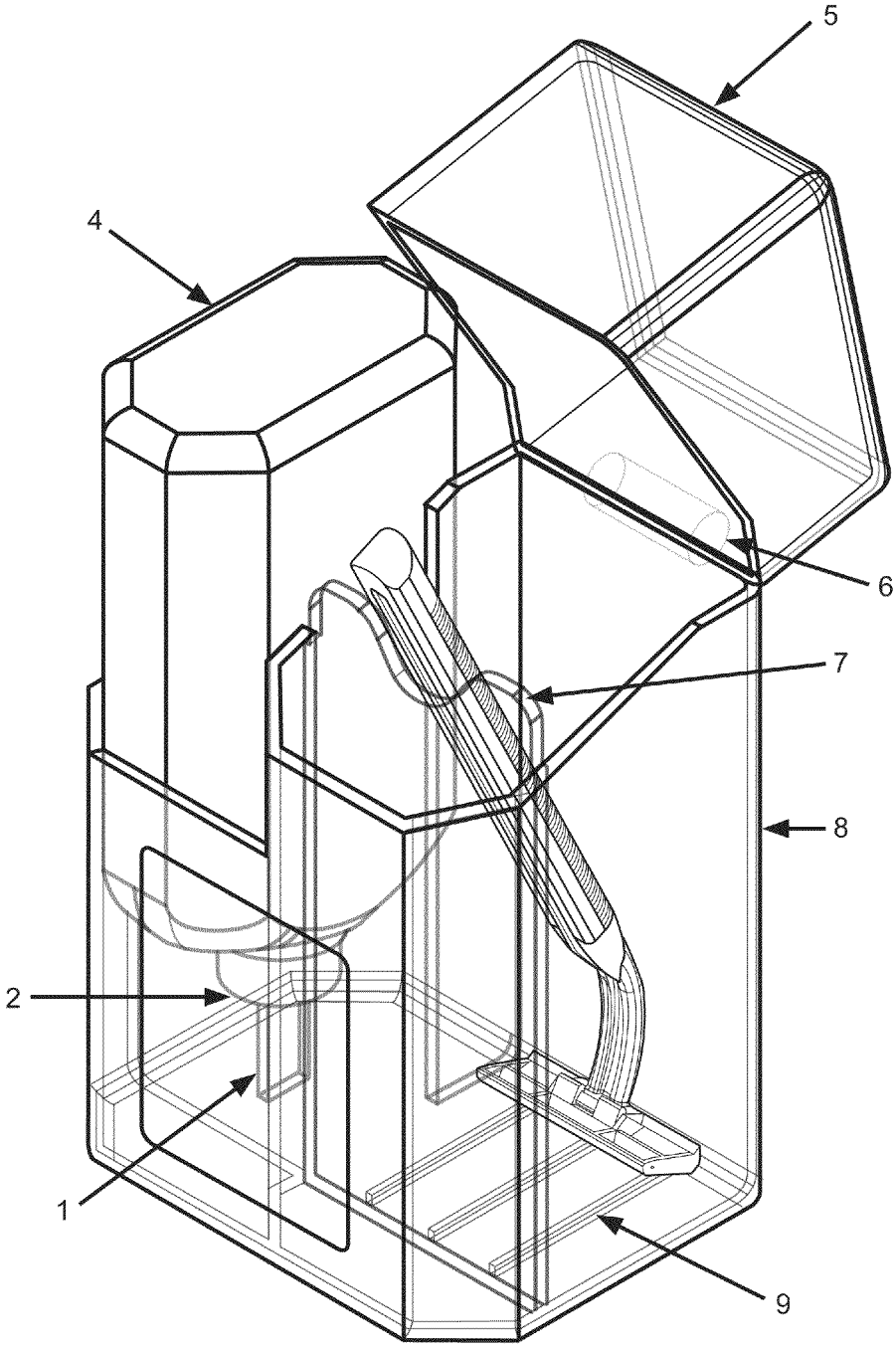
FIG. 2 is an angled front and left side view of the present invention with the flip top open.

FIG. 2 is an angled front and left side view of the present invention with a flip top lid [5] element open and the rest element [7] exposed. The flip top [5] may cover the cleansing chamber [A] of the device, and it incorporates two lift points on the right and left edges [3]. It attaches to the device by means of a small molded plastic hinge [6]. The flip top lid [5] and lift point [3] allow for easy access to insert the razor into the cleaning chamber [A] of the device.

Figure 3:
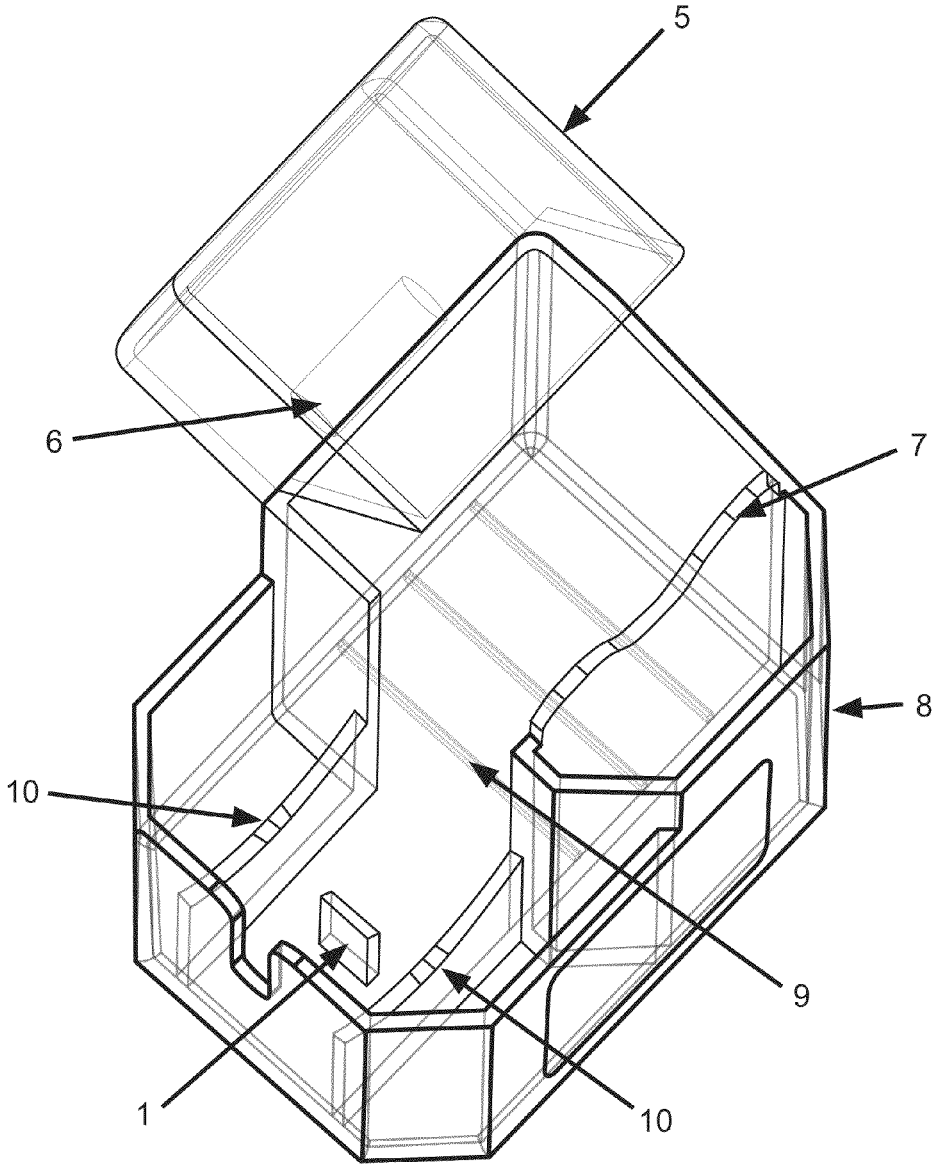
FIG. 3 is an aerial view of the present invention showing an open flip top, a rest element, a knife edge element, two bottle rests, and ridges on the bottom of the cleaning chamber.

FIG. 3 is an aerial view of the present invention with the flip top open [5] and the rest element [7], knife edge element [1], two bottle rests [10], and the rests or ridges [9] on the bottom of the cleaning chamber [A] exposed. The plurality of parallel rests protruding up from the bottom [9], and the cleansing chamber [A] support the razor in the disinfectant solution allowing for hair, skin and other shaving debris to collect in the bottom of the cleaning chamber [A] away from the blades. A rest element [7] elevates the handle of the razor to ensure that the blades of the shaving razor are correctly positioned in the disinfectant solution within the cleaning chamber [A]. A viewing window [8] on the side of the container chamber [B] of the device allows for the user to see the level of disinfectant solution and determine if the cleansing chamber [A] needs to be rinsed out with fresh water to remove any hair, skin and other shaving debris that has collected within the ridges [9] along the bottom of the cleaning chamber [A]. Note that the debris and fluid may also flow into an optional drainage chamber described below.

The rigid storage and cleansing device, the positioning and height of the rest element [7] and the positioning and dimensions of the flip top lid element [5] ensure that all shaving razor designs currently being manufactured can be accommodated.

Optional Chambers

Figure 5:
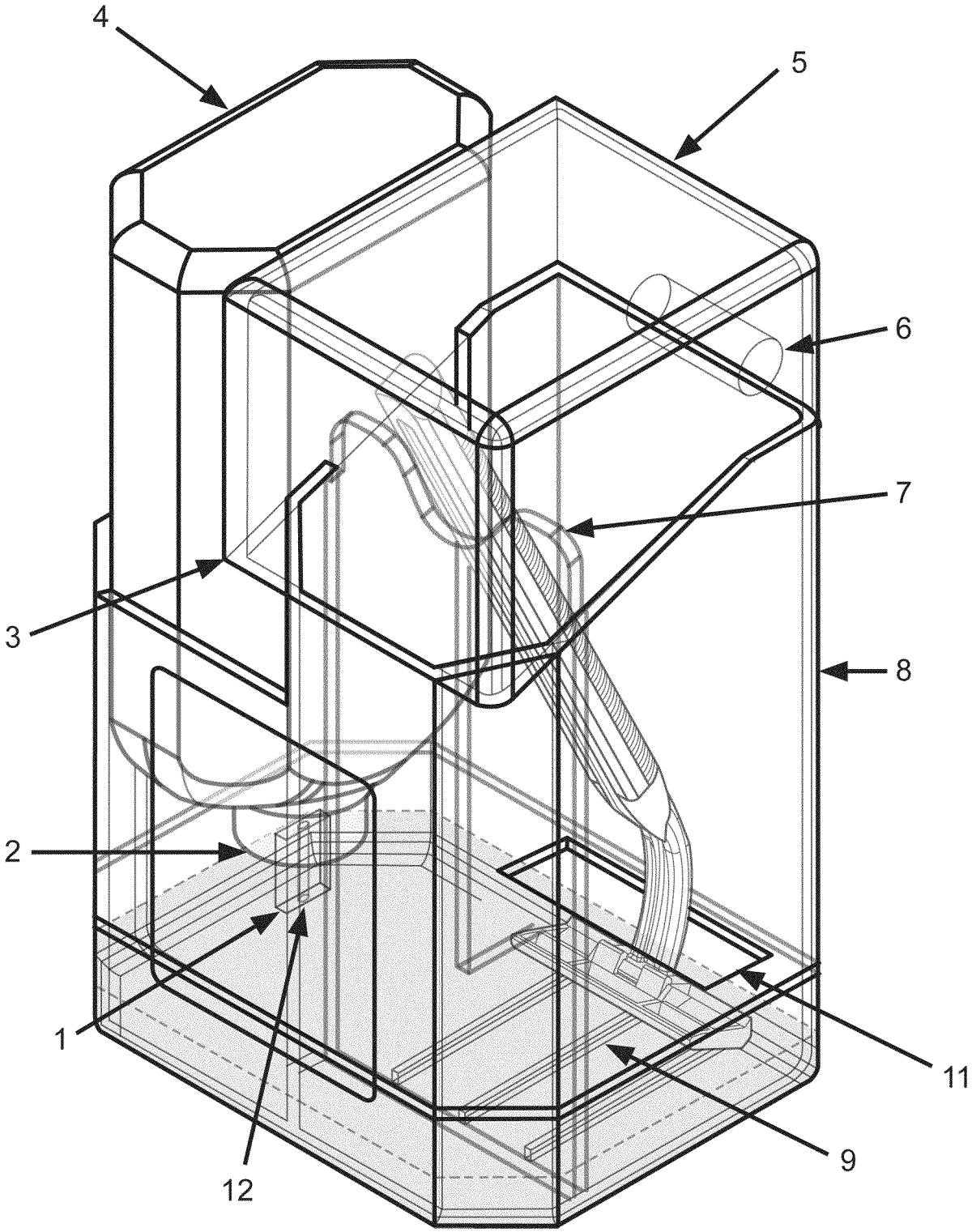
FIG. 5 is an angled front and left side view of the present invention, the flip top closed, showing a false bottom compartment with apertures for the razor head and disinfectant solution level marked bellow the false bottom.

FIG. 5 shows container chamber [B] from the same perspective as in FIG. 1, with a third drainage chamber [C] allowing for the free flow of disinfectant solution into cleansing chamber [A] by means of an aperture spanning and penetrating the sharp edge member protruding from the bottom of the container chamber [B], A final chamber [D] the cleansing chamber [A] is designed to separate the razor head from the debris and clean disinfectant solution. The false bottom with aperture for the razor head [11] and disinfectant solution level [12] are marked. A one-way gasket may be added on aperture [11] within the drainage chamber [C] to seal off cleansing chamber [A], making the drainage chamber leakproof.

It is important to note that the configuration of the system and method shown herein is merely illustrative and should in no way be construed as limiting of the invention. All suitable modifications are permissible and covered within the scope of the claimed invention.

We claim:

1. A storage and disinfection device for a shaving razor comprising:

a cleansing chamber in which to store and disinfect the razor;

container chamber which stores a replaceable container of disinfectant solution, wherein the replaceable container fits snugly within the container chamber;

a partition dividing the cleansing chamber from the container chamber with an aperture allowing the disinfectant to flow easily from the container chamber into the cleansing chamber;

a sharp edge protruding up from the floor of the container chamber to pierce as seal on the replaceable bottle.

2. The device of claim 1, further comprising a plurality of concave rests protruding up from the floor of the container chamber to support the replaceable container at such a height that the disinfectant solution flows to the appropriate level within both the chambers.

3. The device of claim 1, further comprising a plurality of parallel rests protruding up to support the razor in place above the floor of the cleansing chamber, to allow for collection of debris away from the razor.

4. The device of claim 1, in a miniature size for travel.

5. The device of claim 1, further comprising of a flip-top hinged lid to enclose the cleansing chamber holding the razor.

6. The device of claim 1, further comprising a plurality of rests protruding up from the bottom of the cleansing chamber to support the handle of razor.

7. The device of claim 1, wherein the fluid is an alcohol and soap or detergent based solution, mixed with skin conditioner.

8. The device of claim 1, further comprising:

a drainage chamber beneath the two other chambers to support the shaving surface of the razor as well as to hold the disinfectant solution from the container;

a first aperture at the top of the drainage chamber which spans and penetrates the sharp edge member protruding from the bottom of the container chamber, through which to receive the disinfectant solution from the container into the drainage chamber; and a second elongated aperture at the top of the drainage chamber which may receive the shaving surface of the razor from the cleansing chamber in order to ensure it is properly submerged in the disinfectant solution while supported above the floor of the drainage chamber, allowing debris to collect away from the shaving surface of the razor into the drainage chamber.

9. The device of claim 8, made leakproof by means of gaskets sealing the first and second apertures at the top of the drainage chamber as well as the mouth of the container of the disinfectant solution.

10. The device of claim 8, further comprising a plurality of parallel rests protruding up to support the razor in place above the floor of the drainage chamber, to allow for collection of debris from the razor.

11. The method of claim 8, further comprising the step of supporting the replaceable container of liquid solution in place in the container chamber by means of a plurality of concave rests protruding up from the floor of the container chamber to such a height that the disinfectant solution flows to the appropriate level within both the chambers.

12. The method of claim 8, further comprising the step of supporting the razor in place above the floor of the cleansing chamber by a plurality of protruding parallel rests, to allow for collection of debris from the razor.

13. The method of claim 8, further comprising the step of assembling the container chamber, the cleansing chamber and the replaceable container together in a travel size.

14. The method of claim 8, further comprising the step of enclosing the cleansing chamber holding the razor with a flip-top hinged lid.

15. The method of claim 8, further comprising the step of supporting the handle of the razor by means of a plurality of rests protruding up from the bottom of the cleansing chamber.

16. A method of storing and disinfecting a shaving razor comprising the steps:

placing and supporting the razor body in a cleansing chamber;

placing a replaceable container filled with a disinfectant solution snugly within a container chamber;

wherein the container and cleansing chambers are separated by a partition with an aperture allowing the flow of disinfectant solution between them;

piercing a seal on the replaceable container with a sharp edge member protruding from the bottom of the container chamber such that the sharp edge member remains within the mouth of the container;

regulating the flow of the liquid solution to the first and second compartments by means of the sharp edged submerged within the mouth of the container; and allowing the free flow of the disinfectant solution into the cleansing chamber until it reaches the level of a mouth of the container.

17. The method of claim 16, wherein the fluid is an alcohol and soap or detergent based solution, mixed with skin conditioner.

18. The method of claim 16, further comprising the steps of:

receiving and holding the disinfectant solution from the container within a drainage chamber beneath the two other chambers through a first aperture spanning and penetrating the sharp edge member protruding from the bottom of the container chamber;

receiving the shaving surface of the razor from the cleansing chamber through a second aperture at the top of the drainage chamber, in such as a way as to ensure it is properly submerged in the disinfectant solution in the drainage chamber;

supporting the shaving surface of the razor in place above the floor of the drainage chamber, so as to allow debris to collect away from the shaving surface of the razor.

19. The method of claim 18, further comprising the step of sealing the first and second apertures at the top of the drainage chamber as well as the seal of the container of the disinfectant solution by means of gaskets to make the drainage chamber and the container leakproof.

20. The method of claim 18, further comprising the step of supporting the razor in place by means of a plurality of parallel rests protruding up above the floor of the drainage chamber, to allow for collection of debris from the razor.

* * * * *